US009562207B2

(12) United States Patent
DeBlase et al.

(10) Patent No.: US 9,562,207 B2
(45) Date of Patent: Feb. 7, 2017

(54) LUBRICANTS COMPRISING 2-HYDROXYALKYLAMIDE FRICTION MODIFYING COMPOSITIONS

(71) Applicant: Chemtura Corporation, Middlebury, CT (US)

(72) Inventors: Frank J. DeBlase, Hopewell Junction, NY (US); Faith A. Corbo, Roxbury, CT (US)

(73) Assignee: Chemtura Corporation, Middlebury, CT (US)

( * ) Notice: Subject to any disclaimer, the term of this patent is extended or adjusted under 35 U.S.C. 154(b) by 601 days.

(21) Appl. No.: 13/795,328

(22) Filed: Mar. 12, 2013

(65) Prior Publication Data

US 2015/0376537 A1 Dec. 31, 2015

Related U.S. Application Data

(60) Provisional application No. 61/650,534, filed on May 23, 2012.

(51) Int. Cl.
*C10M 133/16* (2006.01)
*C10M 133/56* (2006.01)

(52) U.S. Cl.
CPC ..... *C10M 133/16* (2013.01); *C10M 133/56* (2013.01); *C10M 2203/1025* (2013.01); *C10M 2207/289* (2013.01); *C10M 2215/082* (2013.01); *C10M 2219/068* (2013.01); *C10N 2220/021* (2013.01); *C10N 2220/025* (2013.01); *C10N 2220/026* (2013.01); *C10N 2230/06* (2013.01); *C10N 2240/04* (2013.01); *C10N 2240/042* (2013.01); *C10N 2240/08* (2013.01); *C10N 2240/10* (2013.01); *C10N 2240/102* (2013.01); *C10N 2240/104* (2013.01); *C10N 2240/12* (2013.01); *C10N 2240/14* (2013.01); *C10N 2240/30* (2013.01); *C10N 2240/40* (2013.01)

(58) Field of Classification Search
CPC . C10M 129/36; C10M 133/16; C10M 133/56; C10M 2207/128; C10M 2215/082; C10M 2219/068;C10M 2203/1025; C10M 2207/289; C10N 2220/021; C10N 2220/025; C10N 2220/026; C10N 2240/04; C10N 2240/14; C10N 2240/30; C10N 2240/40; C10N 2240/12; C10N 2240/10; C10N 2240/08; C10N 2240/042; C10N 2240/102; C10N 2230/06; C10N 2240/104
See application file for complete search history.

(56) References Cited

U.S. PATENT DOCUMENTS

| | | | |
|---|---|---|---|
| 4,280,915 | A | 7/1981 | Kercheville |
| 4,512,903 | A | 4/1985 | Schlicht et al. |
| 4,729,769 | A | 3/1988 | Schlicht et al. |
| 4,921,624 | A | 5/1990 | Kammann, Jr. |
| 2003/0009930 | A1 | 1/2003 | DeRosa et al. |
| 2004/0192565 | A1 | 9/2004 | Thiel et al. |
| 2005/0107623 | A1* | 5/2005 | Fox ..... C07B 43/06 554/61 |

FOREIGN PATENT DOCUMENTS

| | | |
|---|---|---|
| EP | 0 957 152 A1 | 11/1999 |
| JP | 10-008079 | 1/1998 |

OTHER PUBLICATIONS

Van Gerpen, J., "Animal Fats for Biodiesel Production", Farm Energy, Jan. 31, 2014, http://articles.extension.org/pages/30256/animal-fats-for-biodiesel-production, downloaded May 18, 2016, 5 pages.

* cited by examiner

*Primary Examiner* — Taiwo Oladapo
(74) *Attorney, Agent, or Firm* — Dilworth IP, LLC

(57) ABSTRACT

Lubricant compositions comprising an improved ashless organic friction modifier additive, capable of reducing both friction and wear, is provided. It has been found that mixtures of fatty-alkanolamides containing secondary hydroxyls on the amino alkyl substituent, such as amide mixtures prepared from bis(2-hydroxyporopyl)amine and mixtures of at least two different $C_{8-24}$ fatty acids, provide better oil solubility and friction reduction than alkanolamides with primary hydroxyl functionality, such as amide mixtures prepared from di-ethanol)amine.

2 Claims, No Drawings

LUBRICANTS COMPRISING 2-HYDROXYALKYLAMIDE FRICTION MODIFYING COMPOSITIONS

This application claims benefit under 35 USC 119(e) of U.S. provisional application No. 61/650,534 filed May 23, 2012, the disclosure of which is incorporated herein by reference.

Lubricant compositions are provided comprising a mixture of secondary alkanolamides of two or more select fatty acids, i.e., a mixture of amides formed from two or more $C_{8-20}$ fatty acids with one or more sec-hydroxyalkyl amines, e.g., a mixture of fatty acid amides of bis-(2-hydroxypropyl) amine, which lubricant compositions exhibit improved friction reduction and anti-wear properties over similar compositions comprising fatty acid amides of 2-ethanolamine, 3-propanolamine or other primary alkanolamines.

BACKGROUND OF THE INVENTION

Reducing friction between moving parts is a fundamental role of lubricants. This is especially significant, for example, in internal combustion engines and power transmission systems found in cars and trucks, in part because a substantial amount of the theoretical mileage lost from a gallon of fuel is traceable directly to friction. A variety of friction modifiers are widely known and used in such lubricants, including fatty acid esters and amides, esters of hydroxyalkyl acids, organo molybdenum compounds and the like.

Molybdenum friction modifiers are widely known and are effective over a broad temperature range, especially upon reaching temperatures of ~120° C. or higher where chemical transformations form Mo-Sulfide glass coatings on surfaces. Molybdenum compounds however have some drawbacks, for example they can complex and interfere with dispersants and like other metal containing compounds, may suffer from particulate formation etc, as seen, for example, with the zinc anti-wear additive above. It is therefore desirable to reduce the amount of such friction modifiers in lubricants.

Fatty acid alkanolamides are known as both fuel additives and lubricant additives and have other uses in addition to friction reduction. For example, U.S. Pat. No. 4,729,769 discloses gasoline compositions containing reaction products of fatty acid esters and alkanolamines as carburetor detergents. The reaction products of mono- and di-alkanolamines of naturally occurring fatty acid derivative mixtures, e.g., the fatty acid glycerides in coconut oil, babasu oil, palm kernel oil, palm oil, olive oil, castor oil, peanut oil, rape oil, beef tallow oil, lard oil, whale blubber oil, and sunflower oil, are also disclosed. Useful amines include mono-ethanolamine, diethanolamine, propanolamine, isopropanolamine, dipropanolamine, di-isopropanolamine, butanolamines etc., although no products containing secondary hydroxyalkyl amines were prepared. The reaction product of diethanolamine with coconut oil is exemplified and preferred.

The amides of U.S. Pat. No. 4,729,769 are disclosed as friction modifiers for lubricants in US Pub Pat Appl 20040192565. As in U.S. Pat. No. 4,729,769 the product of diethanolamine with coconut oil is preferred in part because of the suggestion that mixtures of compounds which include transesterification products involving the hydroxyl group of dialkanolamine/dialkanolamide along with various glyceride side products may be beneficial in improving dispersibility of the amides. Primary hydroxyl groups as found in di-ethanolamine are disclosed as more reactive than secondary hydroxyalkyl amines as found in non-exemplified di-isopropanolamine.

Alkanolamides have an affinity for metal surfaces as found in, e.g., automotive engines, and are believed to form a film that adheres to these surfaces. The most effective friction modifiers form an even, protective surface coating at the metal-metal boundary where the surfaces contact each other, reducing the friction created by the interaction of moving engine parts. However, numerous challenges exist when designing additives that function in this environment without compromising or interfering with other processes or aspects of a smooth running engine.

A significant problem currently facing the development of organic friction modifiers is that while they must be polar enough to absorb on metal surfaces, they must also be soluble enough in the oil, for example, a non-polar mineral oil, so that they are completely solubilzed and not significantly self associated in the lubricant. Agglomerates of self associated compounds will not form the even film required on the metal surfaces for smooth operation of the engine. On the other hand, the compound must not be so soluble in the oil that it fails to come out of solution to coat the metal surfaces in a timely fashion.

U.S. Pat. No. 4,921,624 discloses alkanolamide lubricant additives similar to those of U.S. Pat. No. 4,729,769 and US Appl 20040192565, prepared by reacting a substantially saturated fatty acid triglyceride with a deficiency of dialkanolamine. Using less than one equivalent of amine per carboxy group leaves partially un-reacted mono, di- and tri-glycerides which help solvate the alkanolamides during use. As in the art cited above, products formed by reacting diethanolamine and coconut oil are exemplified. Unreacted glycerides and other reaction byproducts are believed to act as co-solvents and aid in forming stable oil solutions but the amount of the more active fatty acid amide is diluted.

Other attempts to prepare oil soluble alkanolamides include using unsaturated fatty acids in the preparation of the amide. Alkyl chains with unsaturation remove the linearity from the structure disrupting ordered the packing of crystal lattices, making self assembly of amide less likely, which helps keep the amide in solution. But inclusion of oxidizable unsaturates in the additive increases its likelihood of degradation while decreasing the stability of the overall oil formulation.

U.S. Pat. No. 4,512,903 provides lubricant compositions containing amides of hydroxy-substituted aliphatic acids and fatty amines. The use of long chain fatty amines is intended to improve the solubility of polar amide functionality in non-polar oils, however, this approach is often less effective in friction reduction as long non-polar polymer chains can make the molecule so strongly solvated that it does not readily form the desired film at the metal surface.

JP 06-074434 discloses a lubricating oil composition comprising diethanolamides of a $C_{22-24}$ unsaturated acid which is said to be a better friction modifier than di-(hydroxyethanol) oleamide.

U.S. Pat. No. 4,280,915 discloses a water based drilling fluid which comprises an alkanolamide of a saturated $C_{8-20}$ carboxylic acid and an alkanolamide of an unsaturated $C_{18}$ carboxylic acid.

In the existing art, isopropanol amides and di-isopropanol amides are often disclosed but seldom exemplified. JP 10-008079A discloses a lubricating oil composition comprising an amide formed from a mono-alkanolamine and/or dialkanolamine with a $C_{16-24}$ fatty acid as a detergent for reducing sludge. Di-isopropanol stearyl amide is exemplified as a single compound, however, and this product is a waxy solid.

There is a need for developing organic friction modifiers, preferably liquid, which are readily soluble in lubricating oils at ambient temperatures, i.e., room temperature, which form stable, storable oil formulations, but also readily organize to form a smooth film on a metal surface without negatively effecting the bulk performance of the lubricant.

SUMMARY OF THE INVENTION

It is found that additive compositions comprising certain mixtures of fatty acid, sec-hydroxylalkyl amides, such as isopropanol amides, are not only more soluble in lubricants commonly found in automotive applications, but are surprisingly more effective at reducing friction and have superior anti wear properties than either similar single component additives or comparable mixtures of primary hydroxylalkyl amides, such as hydroxyethylamides.

The present invention thus provides lubricant compositions comprising:

a) a major portion of a lubricating oil, and b) a friction reducing/antiwear additive composition comprising a mixture of two or more fatty acid sec-hydroxylalkyl amides of formula I (I)

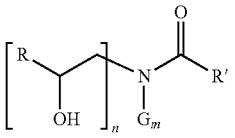

wherein n is 1 or 2; when n is 1, m is 1; when n is 2, m is 0;

R is $C_{1-4}$ alkyl;

G is H or $C_{1-6}$ alkyl; and

R' is selected from the group consisting of $C_{7-19}$alkyl and $C_{7-19}$alkenyl, wherein the mixture of fatty acid sec-hydroxylalkyl amides comprises at least one compound of formula I where R' is $C_{15}$ alkyl or alkenyl and at least one compound of formula I where R' is $C_{17}$ alkyl or alkenyl. Typically, both alkyl and alkenyl groups are present at various R' groups in the amide mixtures.

'Major portion' as used herein denotes that the element being defined, e.g., lubricating oil is present as the majority component in the composition, i.e., greater than 50% by weight based on the total weight of the composition. In the present composition the lubricating oil comprises one or more naturally occurring base stocks, e.g., mineral oils such as petroleum derived oils, or synthetic base stocks, e.g., polyester or silicon lubricants. The friction reducing/antiwear additive composition is present in amounts generally encountered in the art for such additives, e.g., 0.01 to 5 wt % based on the total weight of the lubricant composition. In many embodiments of the invention, other additives commonly known in lubricating compositions are also present in the commonly encountered amounts.

The fatty acid sec-hydroxylalkyl amides are readily prepared by reaction of an appropriate amine with selected fatty acids or fatty acid derivatives such as esters, acid chlorides, anhydrides etc, typically fatty acids or fatty acid esters. Natural sources of fatty acids often contain mixtures of alkylcarboxylates that can be conveniently used to prepare the amide mixture. For example, beef tallow and poultry fat contain mixtures of fatty acid derivatives comprising alkyl carboxy chains that differ in both chain length, e.g., $C_{14}$, $C_{16}$ and $C_{18}$, and degree of saturation, e.g., the saturated $C_{18}$ stearic acid and unsaturated $C_{18}$ oleic acid.

DESCRIPTION OF THE INVENTION

One embodiment provides a lubricant composition comprising:

a) a major portion of a lubricating oil comprising one or more naturally occurring base stocks or synthetic base stocks, and b) from about 0.01 to about 5 wt % based on the total weight of the lubricant composition of a friction reducing/antiwear additive composition comprising a mixture of two or more fatty acid sec-hydroxylalkyl amides of formula I

I

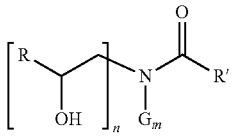

wherein n is 1 or 2; when n is 1, m is 1; when n is 2, m is 0;

R is $C_{1-4}$ alkyl; for example, methyl or ethyl, often R is methyl;

G is H or $C_{1-6}$ alkyl; and

R' is selected from $C_{7-19}$alkyl or alkenyl, for example, $C_{9-19}$ alkyl or alkenyl, wherein the mixture of fatty acid sec-hydroxylalkyl amides comprises at least one compound of formula 1 where R' is $C_{15}$ alkyl or alkenyl and at least one compound of formula 1 where R' is $C_{17}$ alkyl or alkenyl, and wherein the majority of R' groups in the mixture are selected from $C_{13}$, $C_{15}$ and $C_{17}$ alkyl or alkenyl (which correlate with products derived from $C_{14}$, $C_{16}$ and $C_{18}$ fatty acids), for example, the majority of R' groups in the mixture are $C_{15}$ and/or $C_{17}$ alkyl or alkenyl.

For example, one embodiment of the invention provides a lubricant composition comprising:

a) a major portion of a lubricating oil comprising one or more naturally occurring or synthetic base stock, and b) from about 0.01 to about 5 wt % based on the total weight of the lubricant composition, of a friction reducing/antiwear additive composition comprising a mixture of two or more fatty acid sec-hydroxylalkyl amides of formula I, wherein about 15 to about 45% by weight of the sec-hydroxyalkylamides are compounds where R' is $C_{15}$ alkyl or alkenyl, about 40 to about 80% by weight of the sec-hydroxyalkylamides are compounds where R' is $C_{17}$ alkyl or alkenyl, and 0 to about 15% by weight of the sec-hydroxyalkylamides are compounds where R' is $C_{7-14}$, $C_{16}$ or $C_{18-19}$ alkyl or alkenyl;

for example, wherein about 20 to about 35% by weight of the sec-hydroxyalkylamides are compounds where R' is $C_{15}$ alkyl or alkenyl, about 50 to about 75% by weight of the sec-hydroxyalkylamides are compounds where R' is $C_{17}$ alkyl or alkenyl, and 0 to about 15% by weight of the sec-hydroxyalkylamides are compounds where R' is $C_{7-14}$, $C_{16}$ or $C_{18-19}$ alkyl or alkenyl, in some embodiments, 0 to about 15% by weight of the sec-hydroxyalkylamides are compounds where R' is $C_{9-14}$, $C_{16}$ or $C_{18-19}$ alkyl or alkenyl.

$C_{7-21}$alkyl or alkenyl is a straight or branched chain of the designated number of carbon atoms, typically straight chain, which is fully saturated in the case of alkyl and contains one or more carbon-carbon double bonds in the case of alkenyl.

$C_{1-4}$ alkyl and $C_{1-6}$ alkyl represent a straight or branched fully saturated chain of the designated number of carbon atoms, e.g., methyl, ethyl, propyl, isopropyl, butyl, sec-butyl, tert-butyl, pentyl, sec-pentyl, tert-pentyl, hexyl, methylpentyl, ethyl butyl etc.

In many embodiments, n is 2, m is 0 and the sec-hydroxyalkyl amides are compounds of formula II wherein each R is dependently $C_{1-4}$ alkyl:

II

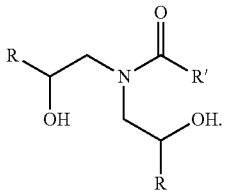

The two R groups in the compound may be the same or different. For example, each R is independently selected from methyl, ethyl, propyl, iso-propyl, butyl, sec-butyl, iso-butyl and tert-butyl, in many embodiments R is methyl or ethyl, for example, methyl. Often R is the same, and in particular embodiments each R is methyl.

The friction reducing/anti-wear composition comprises at least two compounds which differ in the number of carbons at R' in formula I and in many embodiments the amide composition comprises more than two R' groups of differing number of carbon atoms. Further, excellent results are achieved when both alkyl and alkenyl groups are present at R' in the mixture. For example, in one embodiment, about 30 to about 70% by weight of the 2-hydroxyalkylamides are compounds where R' is $C_{7-19}$ alkyl and about 30 to about 70% by weight are compounds where R' is $C_{7-19}$ alkenyl.

In one particular embodiment, the mixture of amides comprises compounds of formula I wherein about 15 to about 45%, for example, about 20 to about 35%, by weight of the sec-hydroxyalkylamides are compounds where R' is $C_{15}$ alkyl or alkenyl wherein a majority, for example, about 75% or more, 90% or more, or 95% or more of the $C_{15}$ alkyl or alkenyl are alkyl; about 40 to about 80%, for example, about 50 to about 75%, by weight of the sec-hydroxyalkylamides are compounds where R' is $C_{17}$ alkyl or alkenyl, wherein about 40 to about 95% of said $C_{17}$ alkyl or alkenyl are alkenyl; and 0 to about 15% by weight of the sec-hydroxyalkylamides are compounds where R' is $C_{7-14}$, $C_{16}$ or $C_{18-19}$ alkyl or alkenyl, for example, $C_{6-14}$, $C_{16}$ or $C_{18-19}$ alkyl or alkenyl.

In some embodiments, about 15 to about 45% of the secondary hydroxyalkyl amides are compounds wherein R' is fully saturated $C_{15}$ alkyl, and a portion of the secondary hydroxyalkyl amides are compounds where R' as $C_{17}$ are saturated alkyl and a portion are alkenyl. In many embodiments about 20 to about 35% by weight of the sec-hydroxyalkylamides are compounds wherein R' is fully saturated $C_{15}$ alkyl and both $C_{17}$ alkyl and $C_{17}$ alkenyl as R' are present.

The friction reducing/antiwear additive composition comprising a mixture of two or more fatty acid sec-hydroxylalkyl amides of formula I, b), is present in the lubricant composition from about 0.01 to about 5 wt % based on the total weight of the lubricant composition, for example from about 0.05 to about 5 wt %, from about 0.1 to about 4 wt %, from about 0.1 to about 3 wt %, from about 0.5 to about 2 wt %, or from about 0.5 to about 1.5 wt % or to about 1 wt %, based on the total weight of the lubricant composition.

The mixture of two or more fatty acid sec-hydroxylalkyl amides of the present additive composition are readily available by known means. For example, appropriate hydroxyalkyl amine, or mixtures of hydroxyalkyl amines, are reacted with selected fatty acids or fatty acid derivatives such as esters, acid chlorides, anhydrides etc. Typically the amine(s) is reacted with fatty acids or fatty acid esters. Reactions may be run using a base or acid catalyst, with or without solvent. For example, known reactions between hydroxylalkylamine and fatty acid, often acid catalyzed, or reaction between hydroxylalkyl amine and fatty acid derivative such as acid chloride or ester, often base catalyzed, may be employed.

The hydroxyalkylamino portion of the amides of formula I that make up the additive mixture may be the same or different. For example, a single amine such as di-2-hydroxypropyl amine is reacted with a mixture of fatty acids or fatty acid esters providing a mixture of amides differing only at R'. It is also possible that a mixture of sec-hydroxylalkyl amines can be used to prepare a mixture of amides which differ at R' and at the amino functionality, such as reacting a mixture of fatty acids or fatty acid esters with a mixture of amines, e.g., di-2-hydroxypropyl amine and mono-2-hydroxypropylamine.

The components of the present amide mixture can be prepared individually and then blended, for example, one may separately preparing a compound of formula I with R' equal to $C_{15}$ alkyl, a compound with R' equal to $C_{17}$ alkyl, and a compound with R' equal to $C_{17}$ alkenyl etc., and then blend them. However, it is generally more convenient to prepare the amide mixture directly by reacting the hydroxyalkylamine(s) with a mixture of fatty acids or fatty acid esters with different alkylcarboxy chain lengths.

Conveniently, there are naturally occurring sources of fatty acid mixtures, often mixtures of fatty acid derivatives such as esters, that contain a mixture of carboxylate groups ideal for the preparation of the present amide mixture. For example, beef tallow contains esters, e.g., glycerides, diglycerides, triglycerides etc., of palmitic acid (saturated $C_{16}$ acid), stearic acid (saturated $C_{18}$ acid), oleic acid(monounsaturated $C_{18}$ acid) and smaller amounts of poly-unsaturated $C_{18}$ acids and other fatty acids. Thus, using beef tallow as the source of the alkylcarboxy portion of the hydroxyalkyl amides provides a mixture of predominately palmitic, stearyl and oleic amides, i.e., compounds of formula I wherein R' is $C_{15}$ alkyl, $C_{17}$ alkyl and $C_{17}$ alkenyl.

It is possible to use the natural source as it is obtained, for example, a mixture of glycerides, or the natural mixture of products can be hydrolyzed to a fatty acid mixture or otherwise transformed, e.g., transesterified with a smaller alcohol, prior to use. For example, a tallow triglyceride can be reacted with methanol to provide a mixture of methyl tallate esters which can be reacted with the desired amine; the tallow triglyceride can be hydrolyzed to a tallow acid mixture and then reacted with the amine; or the triglyceride can be directly reacted with amine. Each of these methods can be used to prepare the same, or roughly the same amide mixture, however, processing conditions and side products will vary.

A variety of naturally occurring mixtures of two or more fatty acids or fatty acid derivatives are available which provide an appropriate mixture alkylcarboxylates for use in preparing the instant amide mixtures and include, for example, beef tallow, poultry fat, cocoa butter, illipe, lard (pork fat) and palm oil etc. For example, the approximate weight % of fatty acids/derivatives:

| | Palmitic acid saturated $C_{16}$ | Stearic acid saturated $C_{18}$ | Oleic acid unsaturated $C_{18}$ acids | Linoleic acids |
|---|---|---|---|---|
| beef tallow | 24 | 19 | 43 | 4 |
| cocoa butter | 25 | 38 | 35 | 10 |
| illipe | 17 | 45 | 35 | 1 |
| lard (pork fat) | 26 | 14 | 44 | 10 |
| palm oil | 45 | 4 | 40 | 10 |

When preparing the amide mixture of the invention a full equivalent of amine or more than an equivalent of amine per carboxy group is employed in the reaction. Unlike the compositions of U.S. Pat. No. 4,921,624, wherein a deficit of amine is used to generate a mixture of esters, glycerols and amides, and also unlike the typically primary alkanolamides of US20040192565 and U.S. Pat. No. 4,729,769, wherein it is suggested that similar esters and glycerol byproducts are beneficial in assisting amide compatibility, the amide mixtures of the present invention are soluble in the lubricant composition without glycerides and glyceride by products.

That is, the friction modifier of the present invention remains oil-soluble without the addition of partially reacted triglycerides or other co-solvents to create a more compositionally stable lubricant. The instant compositions therefore have a more effective concentration of alkanolamide than typically found with diethanolamine alkanolamides as the present amides are conveniently used as undiluted mixtures of amides, and the present amides are more likely to remain soluble in the lubricant even if there is some breakdown of the formulation during use.

The present invention also provides a mixture of amides with longer alkylcarboxy chains (i.e., a majority of $C_{16}$ palmitic, i.e., R' is $C_{15}$, and $C_{18}$ stearyl and oleic amides, i.e., R' is $C_{17}$) than many of the exemplified diethanolamine amides prepared with coconut oil, which contains a large amount of the smaller, $C_{12}$ lauric acid. The mixtures of the invention are also liquid at room temperature as opposed to single compounds such as di-(2-hydroxypropyl) stearamide.

Given the excellent solubility of the present secondary hydroxyalkyl amides in lubricating oils, it is quite surprising that these compounds also appear to form superior films on metal surfaces as deduced from superior performance in friction reduction and wear resistance when compared to primary hydroxyalkyl amides, such as products formed from $C_{16}$ and $C_{18}$ fatty acids and diethanolamine, or individual compounds such as the di-(2-hydroxypropyl) stearamide.

For example, a direct comparison was made between di-isopropanol tallow amides and the corresponding tallow diethanol amides. The di-isopropanol amides were much more soluble in standard automotive motor oil than the more but diethanolamides, yet the di-isopropanol amides displayed unexpectedly better friction reduction performance. In general, reducing the polarity of the molecule (making it more oil soluble) would be expected to reduce the polar-metal interactions thereby decreasing its friction modifier performance. With the present inventive amide mixtures this did not occur, and in fact the performance was improved. It is not known presently what causes this improved friction reduction tribological performance. Not wanting to be bound by theory, the inventors suggest that possibly the manner in which the better oil solubility is achieved prevents organized chemical structures, i.e., aggregates, of the amides in solution, allowing only for such molecular assembly at the metal surface. So a net greater effective concentration, i.e., more favorable to forming desired surface structures from the active ingredient, resides in the oil throughout use, and remains available to the metal surfaces as needed.

Surprisingly, the films formed on the metal surfaces appears to be more robust than that obtained from molybdenum based friction modifiers. For example, as shown in the Examples, when an oil containing the amides of the invention is exposed to metal surfaces at temperatures of about 160° C. and then replaced by an oil that does not contain the amide, a significant reduction in friction remains, presumably due to the presence of the lubricating film. A similar test using a Mo friction modifier shows that while the Mo compound reduces friction considerably when part of the oil formulation, there is almost no retention of this friction reduction after the oil is replaced with an oil that does not contain the Mo friction modifier.

Oil formulations comprising the amides of the invention have been tested to make sure that they meet all requirements of existing commercial oils in addition to the surprisingly beneficial friction reduction. The compositions meet all the performance criteria for automotive oils as measured by standard tests for stability, Sn, Cu and Pb metal corrosion, wear, thermal stability, compatibility with standard additives and volatility.

Commercial lubricant formulations typically contain a variety of other additives, for example, dispersants, detergents, corrosion/rust inhibitors, antioxidants, other anti-wear agents, anti-foamants, other friction modifiers, seal swell agents, demulsifiers, V.I. improvers, pour point depressants, and the like. A sampling of these additives can be found in, for example, U.S. Pat. No. 5,498,809 and U.S. Pat. No. 7,696,136, the relevant portions of each disclosure is incorporated herein by reference, although the practitioner is well aware that this comprises only a partial list of available lubricant additives. It is also well known that one additive may be capable of providing or improving more than one property, e.g., an anti-wear agent may also function as an anti-fatigue and/or an extreme pressure additive.

The lubricant compositions of this invention will often contain any number of these additives. Thus, final lubricant compositions of the invention will generally contain a combination of additives, including the inventive friction modifying additive combination along with other common additives, in a combined concentration ranging from about 0.1 to about 30 weight percent, e.g., from about from about 0.5 to about 10 weight percent based on the total weight of the oil composition, For example, the combined additives are present from about 1 to about 5 weight percent.

Given the ubiquitous presence of additives in a lubricant formulation, the amount of lubricating oil present in the inventive composition is not specified above, but in most embodiments, except additive concentrates, the lubricating oil is a majority component, i.e., present in more than 50 wt % based on the weight of the composition, for example, 60 wt % or more, 70 wt % or more, 80 wt % or more, 90 wt % or more, or 95 wt % or more.

One embodiment of the invention is therefore a lubricant composition comprising a) from about 70 to about 99.9 wt % of a natural or synthetic lubricating oil base stock, b) from about 0.05 to about 5 wt % based on the total weight of the lubricant composition, of a friction reducing/antiwear additive composition comprising a mixture of two or more fatty acid sec-hydroxylalkyl amides of formula I as described in the above embodiments, and c) one or more additional lubricant additives selected from the group consisting of dispersants, detergents, corrosion/rust inhibitors, antioxidants, other anti-wear agents, anti-foamants, other friction modifiers, seal swell agents, demulsifiers, V.I. improvers and pour point depressants, wherein the combined amount of b) and c) present in the composition is from about 0.1 to about 30 weight percent based on the total weight of the lubricant composition.

In another embodiment the lubricating oil base stock is present from about 90 to about 99.5 wt % and the combined amount of b) and b) is from about 0.5 to about 10 weight percent; and in some embodiments the base stock is present from about 95 to about 99 wt % and the combined amount of b) and c) is from about 1 to about 5 weight percent based on the total weight of the lubricant composition.

The natural or synthetic lubricating oil of the invention can be any suitable oil of lubricating viscosity as described for example in co-pending U.S. application Ser. No. 12/371,872, the relevant portions of which are incorporated herein by reference. For example, a lubricating oil base stock is any natural or synthetic lubricating oil base stock, or mixtures thereof, having a kinematic viscosity at 100° C. of about 2 to about 200 cSt, about 3 to about 150 cSt, and often about 3 to about 100 cSt. Suitable lubricating oil base stocks include, for example, mineral oils such as those derived from petroleum, oils derived from coal or shale, animal oils, vegetable oils and synthetic oils. The relevant portions of co-pending U.S. application Ser. No. 12/371,872 are incorporated herein by reference.

Synthetic oils include hydrocarbon oils and halo-substituted hydrocarbon oils, such as polymerized and interpolymerized olefins, gas-to-liquids prepared by Fischer-Tropsch technology, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from monocarboxylic acids or diacids and polyols and polyol ethers. Other esters useful as synthetic oils include those made from copolymers of alphaolefins and dicarboxylic acids which are esterified with short or medium chain length alcohols.

The synthetic oils may comprise at least one of an oligomer of an α-olefin, an ester, an oil derived from a Fischer-Tropsch process, and a gas-to-liquid stock. Synthetic base stock lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1 octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs, and homologs thereof.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly alphaolefins, and the like.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the waxes produced by the Fischer-Tropsch process.

In many embodiments, the oil base stock comprises mineral oils. For example, the lubricating oil of the invention may be a petroleum oil, or a mixture comprising a petroleum oil. Many other embodiments include vegetable oils, paraffinic oils, naphthenic oils, aromatic oils, and derivatives thereof, often as combination of base stocks.

Useful base stocks from vegetable and animal sources include, for example, alkyl esters of fatty acids, which include commercial mixtures of the ethyl, propyl, butyl and especially methyl esters of fatty acids with 12 to 22 carbon atoms. For example, lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid, or erucic acid are useful and have an iodine number from 50 to 150, especially 90 to 125. Mixtures with particularly advantageous properties are those which contain mainly, i.e., at least 50 wt. %, methyl esters of fatty acids with 16 to 22 carbon atoms and 1, 2, or 3 double bonds. The preferred lower alkyl esters of fatty acids are the methyl esters of oleic acid, linoleic acid, linolenic acid, and erucic acid.

Often the base stock of lubricating viscosity can comprise a Group I, Group II, or Group III base stock or base oil blends of the aforementioned base stocks, for example, the oil of lubricating viscosity is a Group II or Group III base stock, or a mixture thereof, or a mixture of a Group I base stock and one or more of a Group II and Group III. Generally a major amount of the oil of lubricating viscosity is a Group II, Group III, Group IV, or Group V base stock, or a mixture thereof. The base stock, or base stock blend, typically has a saturate content of at least 65%, e.g., at least 75% or at least 85%. Most preferably, the base stock, or base stock blend, has a saturate content of greater than 90%.

Definitions for the base stocks and base oils in this invention are the same as those found in the American Petroleum Institute (API) publication "Engine Oil Licensing and Certification System," Industry Services Department (14th ed., December 1996), Addendum 1, December 1998. This publication categorizes base stocks as follows.

(a) Group I base stocks contain less than 90 percent saturates (as determined by ASTM D 2007) and/or greater than 0.03 percent sulfur (as determined by ASTM D 2622, ASTM D 4294, ASTM D 4927 and ASTM D 3120) and have a viscosity index greater than or equal to 80 and less than 120 (as determined by ASTM D 2270).

(b) Group II base stocks contain greater than or equal to 90 percent saturates (as determined by ASTM D 2007) and less than or equal to 0.03 percent sulfur (as determined by ASTM D 2622, ASTM D 4294, ASTM D 4927 and ASTM D 3120) and have a viscosity index greater than or equal to 80 and less than 120 (as determined by ASTM D 2270).

(c) Group III base stocks contain greater than or equal to 90 percent saturates (as determined by ASTM D 2007) and less than or equal to 0.03 percent sulfur (as determined by ASTM D 2622, ASTM D 4294, ASTM D 4927 and ASTM D 3120) and have a viscosity index greater than or equal to 120 (as determined by ASTM D 2270).

(d) Group IV base stocks are polyalphaolefins (PAO).

(e) Group V base stocks include all other base stocks not included in Groups I, II, III, or IV.

The lubricating oil compositions of the invention can be used in a variety of applications, for example, crankcase lubricating oils for spark-ignited and compression-ignited internal combustion engines, gas engine lubricants, turbine lubricants, automatic transmission fluids, gear lubricants, compressor lubricants, metal-working lubricants, hydraulic fluids, and other lubricating oil and grease compositions.

EXAMPLES

A carboxylic acid mixture obtained from beef tallow was heated with methanol in the presence of catalytic p-toluene sulfonic acid using well known methods to generate a mixture of methyl tallate esters.

Example 1

The methyl tallate esters from above, toluene solvent and catalytic sodium methoxide were heated to approximately 60° C. and a slight excess of bis-(2-hydroxypropylamine) was added. The resulting mixture was heated to about 120° C. and stirred for 4 hours to yield a mixture of bis-(2-hydroxypropylamine) fatty acid amides, predominately stearyl, oleic and palmitic amides plus smaller quantities of other amides corresponding to the tallow acid mixture above, as a clear, liquid/oil.

Example 2c

Following the procedure of Example 1 and using di-ethanolamine in place of bis-(2-hydroxypropylamine), yielded a mixture of di-ethanolamine fatty acid amides, predominately stearyl, oleic and palmitic amides plus smaller quantities of other amides corresponding to the tallow acid mixture above, as a solid.

Example 3c

Following the procedure of Example 1 and using methyl stearate in place of the methyl tallate esters yielded stearyl [bis-(2-hydroxypropyl)amide] as a waxy solid.

Example 4c

Following the procedure of Example 1 and using methyl oleate in place of the methyl tallate esters yielded oleic [bis-(2-hydroxypropyl)amide].

Example 5c

Following the procedure of Example 2 and using methyl oleate in place of the methyl tallate esters yielded oleic di-ethanolamide.

Example 6c

Following the procedure of Example 1 and using methyl cocoate (methyl ester mixture derived from coconut oil) in place of the methyl tallate esters yielded a mixture of bis-(2-hydroxypropylamine) fatty acid amides, approximately 45-50% of the mixture being lauryl amide, 15-20% myristyl amide, 10-20% caprylic and capric amides, and 10-25% being amides of $C_{16}$ and $C_{18}$ acids, as a clear, liquid/oil.

Example 7

Cameron Plint Tribological Performance Data

The amide products from Examples 1, 2c, *3c, 4c and 6c were each added to a fully formulated mineral based Group III 5W30 Engine oil at a 1 wt % loading based on the total weight of the final test oil composition. The friction coefficient of each test oil composition was measured, using standard Cameron Plint Tribology methods, at variety of temperatures and compared to the friction coefficient of the same oil without the inventive friction modifier composition.

| | Friction coefficient (–) at | | |
|---|---|---|---|
| Amide Additive | 102° C. | 132° C. | 162° C. |
| None | 0.112 | 0.108 | 0.092 |
| Ex. 1 | 0.076 | 0.065 | 0.056 |
| Ex. 2c | 0.088 | 0.075 | 0.072 |
| * Ex. 3c | 0.096 | 0.083 | 0.074 |
| Ex. 4c | 0.077 | 0.068 | 0.068 |
| Ex. 6c | 0.088 | 0.069 | 0.064 |

* At 0.5 wt %, the stearamide from Example 3 is not stable in solution in this oil at lower temperatures (5° C.) forming a solid and falling out of solution overnight in the refrigerator.

Example 8

The amide products from Examples 1, 2c, and 4c were each added to a fully formulated Synthetic based Group IV 5W30 Engine oil (PAO1) at a 1 wt % loading based on the total weight of the final test oil composition. The friction coefficient of each test oil composition was measured, using standard Cameron Plint Tribology methods, at variety of temperatures and compared to the friction coefficient of the same oil without the inventive friction modifier composition. The results are shown in the table below:

| | Friction coefficient (–) | | |
|---|---|---|---|
| Amide Additive | 102° C. | 132° C. | 162° C. |
| None | 0.105 | 0.115 | 0.098 |
| Ex. 1 | 0.075 | 0.065 | 0.062 |
| Ex. 2c | 0.085 | 0.077 | 0.075 |
| Ex. 4c | 0.085 | 0.075 | 0.065 |

Example 9

A mixture of amides was prepared according to Experiment 1 and added to a fully formulated mineral based Group III 5W30 Engine oil at 0.1, 0.25, 0.5, 1 and 2 wt % loading based on the total weight of the final test oil composition. The friction coefficient of each test oil composition was measured, using standard Cameron Plint Tribology methods, at variety of temperatures and compared to the friction coefficient of the same oil without the inventive friction modifier composition.

| Wt % Amide Additive | Friction coefficient (–) 102° C. | 132° C. | 162° C. |
|---|---|---|---|
| 0.1 | 0.079 | 0.068 | 0.058 |
| 0.25 | 0.074 | 0.066 | 0.055 |
| 0.5 | 0.064 | 0.057 | 0.051 |
| 1 | 0.065 | 0.055 | 0.050 |
| 2 | 0.071 | 0.060 | 0.050 |

Example 10

Change in Friction after Non Add Oil Replacement

The amide products from Example 1, glycerol monooleate (GMO), and two commercial molybdenum dithiocarbamates (MoFR1, MoFR2) were each added to a fully formulated Group III 5W30 Engine oil at a 1 wt % loading based on the total weight of the final test oil composition. The friction coefficient of each test oil composition was measured, using standard Cameron Plint Tribology methods, at variety of temperatures up to about 160° C. The temperature was held at about 160° C., the motor turned off and the oil was removed, without moving the pin/plate. The fully formulated Group III 5W30 Engine oil without the additional amides of Ex 1, GMO, MoFR 1 or MoFR was added at 160° C., the motor was turned on and the friction coefficient was over an additional 90 minutes. The data below shows that the reduction in friction from the oil with the added amides of Ex 1 is maintained after the oil was replaced with an oil with the additive compared to the other additives tested.

| Additive | Friction coefficient (–) at 160° C. standard test w/additive | after 90 min oil wo/additive |
|---|---|---|
| None | ~0.100 | — |
| Ex 1 | 0.062 | 0.074 |
| GMO | 0.077 | 0.086 |
| MoFR1 | 0.030 | 0.087 |
| MoFR2 | 0.033 | 0.089 |

What is claimed:

1. A lubricant composition comprising:

a) a major portion of a lubricating oil comprising one or more naturally occurring and/or synthetic base stocks, and b) from 0.5 to 1 wt % based on the total weight of the lubricant composition of a friction reducing/antiwear additive composition comprising a mixture of two or more fatty acid 2-hydroxyalkylamides of formula II

II

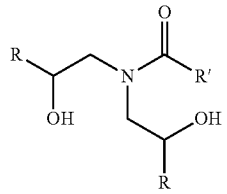

wherein R is methyl;

and R' is selected from $C_{7-19}$ alkyl or alkenyl, wherein about 20 to about 35% by weight of the 2-hydroxyalkylamides are compounds where R' is $C_{15}$ alkyl or alkenyl, wherein about 75% or more of said $C_{15}$ alkyl or alkenyl are alkyl, about 50 to about 75% by weight of the 2-hydroxyalkylamides are compounds where R' is $C_{17}$ alkyl or alkenyl, wherein about 40% to about 95% of said $C_{17}$ alkyl or alkenyl are alkenyl wherein the mixture of two or more fatty acid 2-hydroxyalkylamides of formula II are prepared from a hydroxyalkylamine and a mixture of fatty acids or fatty acid esters with different alkylcarboxy chain lengths obtained from beef tallow.

2. The lubricant composition according to claim 1, comprising a) from about 90 to about 99.5 wt % of a natural or synthetic lubricating oil base stock, b) from 0.5 to 1 wt % based on the total weight of the lubricant composition, of the friction reducing/antiwear additive composition comprising a mixture of two or more fatty acid 2-hydroxyalkylamides of formula I, and c) one or more additional lubricant additives selected from the group consisting of dispersants, detergents, corrosion/rust inhibitors, antioxidants, other anti-wear agents, anti-foamants, other friction modifiers, seal swell agents, demulsifiers, V.I. improvers and pour point depressants, wherein the combined amount of b) and c) present in the composition is from about 0.5 to about 10 weight percent based on the total weight of the lubricant composition.

* * * * *